US005820398A

United States Patent [19]

Stabroth et al.

[11] Patent Number: 5,820,398

[45] Date of Patent: Oct. 13, 1998

[54] CONNECTOR HAVING ADDITIONAL LOCKING

[75] Inventors: Waldemar Stabroth, Eckental; Wolfgang Hoschek, Walldorf, both of Germany

[73] Assignee: Framatome Connectors International, Courbevoie, France

[21] Appl. No.: 815,108

[22] Filed: Mar. 11, 1997

[30] Foreign Application Priority Data

Mar. 11, 1996 [DE] Germany ..... 196 09 522.0

[51] Int. Cl.[6] ..... H01R 13/627

[52] U.S. Cl. ..... 439/352

[58] Field of Search ..... 439/350–358, 439/489, 490

[56] References Cited

U.S. PATENT DOCUMENTS 4,634,204 1/1987 Detter et al. ..... 439/352
4,950,179 8/1990 Takewouchi et al. ..... 439/352
5,292,258 3/1994 Sakurai ..... 439/352
5,605,471 2/1997 Peyler ..... 439/352
5,624,271 4/1997 Childs et al. ..... 439/352

*Primary Examiner*—Hien Vu
*Attorney, Agent, or Firm*—Pollock, Vande Sande & Priddy

[57] ABSTRACT

This invention relates to a connector having a two-part casing (1, 2) whose parts are adapted to be plugged together, the first casing part (1) engaging at least to some extent by way of a collar (3) around the second casing part (2) in the plugged-together position; and an additional latchable locking means (4, 5) disposed on the two casing parts (1, 2). The additional locking means comprises: a catch projection (4) disposed on the collar surface (3); a locking arm (5) secured to the second casing part (2) and co-operating with the catch projection (4), and a slide (7) as a means for securing the locking arm, the slide (7) being movable on the locking arm (5) lengthwise thereof and prolonging the locking arm (5) into an advanced position until the locking arm engages in a stirrup (6) disposed on the collar (3) after the catch projection (4) as seen from the locking arm (5).

7 Claims, 3 Drawing Sheets

CONNECTOR HAVING ADDITIONAL LOCKING

FIELD OF THE INVENTION

This invention relates to a connector having supplemental latchable locking means, of the type used, for example, in cases in which the pluggable connection experiences along the plugging axis a pull which may cause accidental disengagement of the connector parts, something which must be prevented.

BACKGROUND OF THE INVENTION

FIG. 4 shows a prior art connector having a plug part 1 and a complementary second part 2, the part 1 having a collar near the plug pins. A catch projection 4 is disposed on the outside surface of the collar and its ramp-like surface slopes down towards the pins. The second part of the prior art connector has a locking arm 5 which is formed with a slot and which is secured by way of foot on the casing of the second part of the connector. The foot is disposed between the ends of the locking arm, so that, when the connection end of the locking arm is pushed down, the front part thereof is raised so that it can be raised far enough for the slot, which is in the front part of the arm 5 and in which the catch projection 4 has engaged in the latched position, can disengage from the catch projection so that the plug-in connection can be released.

A disadvantage of an additional locking of this kind is that it can be released accidentally, for example, when the sleeve part is pulled in a downward inclination so that the locking arm is raised and simultaneously a force component releases the connection.

SUMMARY OF THE INVENTION

It is an object of this invention so to improve a connector of the kind described that the additional locking is protected against accidental release.

A specfic object of the invention is to secure the locking arm in the position in which it is latched by the catch projection, by an additional feature, i.e., pushing the lockable catch arm securing means forward. This is achieved by the locking arm securing means engaging in a stirrup in this position. In its end position, the locking arm securing means projects beyond the hoop so that an optical indication is given that the additional locking means cannot be released in this position.

BRIEF DESCRIPTION OF THE DRAWINGS

An embodiment of the invention will be described in greater detail hereinafter with reference to the attached drawings, wherein.

DESCRIPTION OF THE PREFERRED EMBODIMENT

Figures 1, 2:
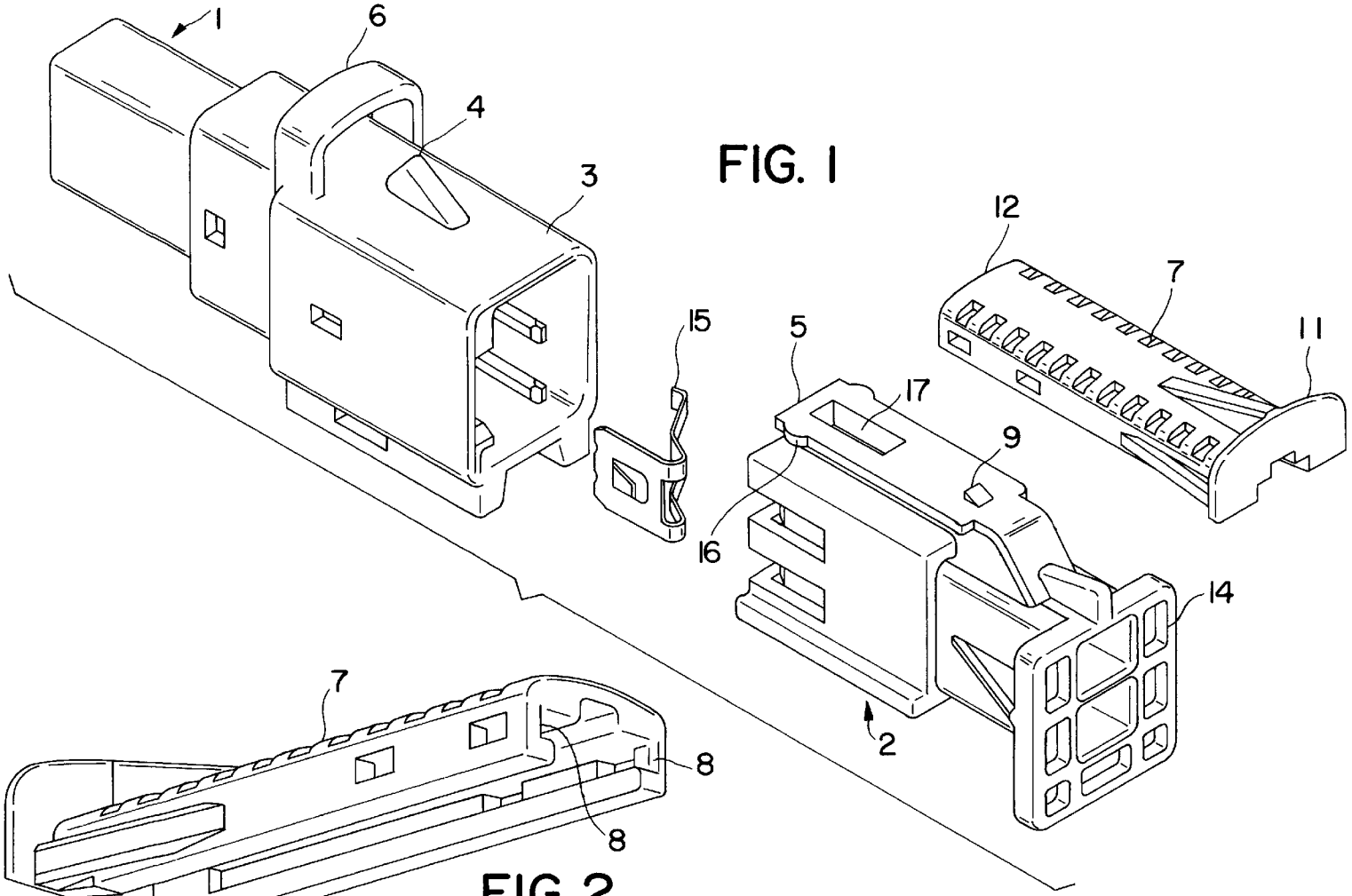
FIG. 1 is a perspective view of the main components of the connector according to the invention.
FIG. 2 is a detail view of the slide.
Figure 3:
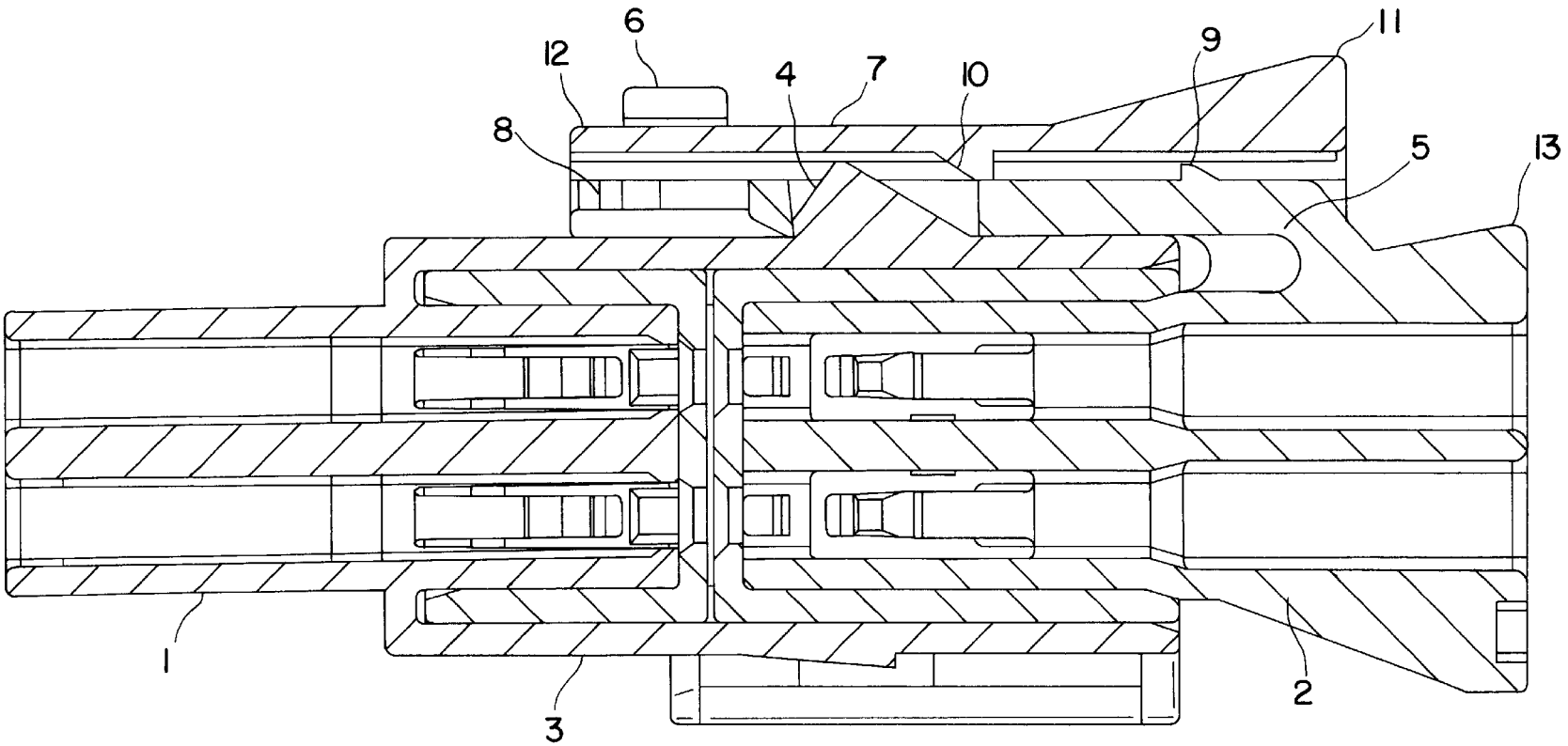
FIG. 3 shows the connector according to the invention in the plugged-together and latched position.
Figure 4:
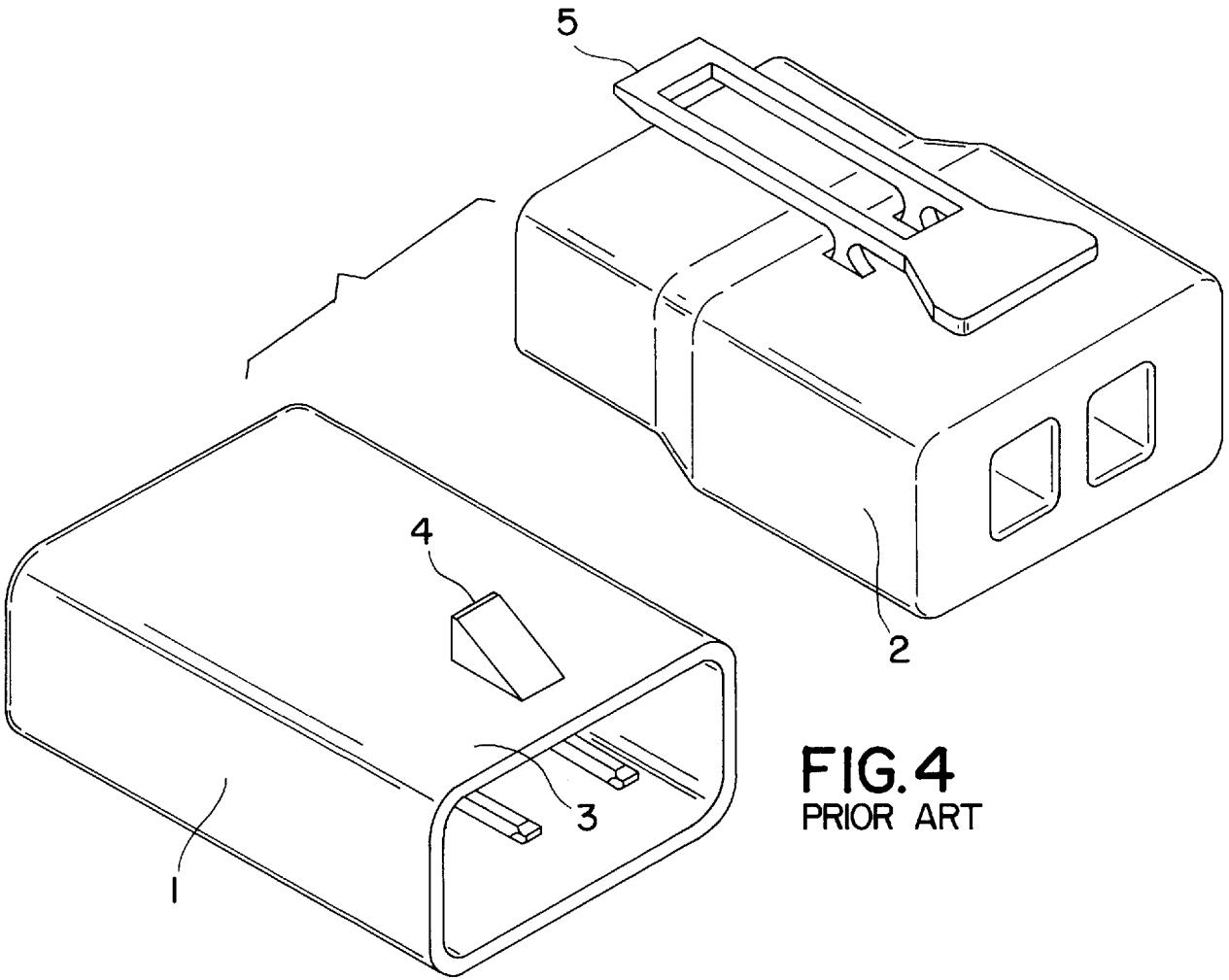
FIG. 4 PRIOR ART
FIG. 4 shows a prior art connector which has additional locking.

The connector shown in FIG. 1 has a first casing member 1, the same having a collar 3 to protect the plug pins. A ramp-like catch projection 4 is disposed on the collar surface with the ramp surface sloping shallowly down in the plugging direction. Opposite the catch shoulder of the projection 4 is a stirrup 6 which will be described in greater detail hereinafter. The second casing member has in its front region the second plug part which is complementary to the first plug part and which, with the connector in closed position, completely engages in the collar 3 which surrounds the pins of the first casing part 1. The foot of a locking arm 5 is disposed on the second casing member behind the second connector part, the locking arm extending substantially parallel to the surface of the collar 3 and above the same. When the first and second casing members are plugged together, the forward end of locking arm 5 is raised by the ramp surface of catch projection 4, so as to snap resiliently into the latched position when catch projection 4 is fully engaged in a corresponding aperture 17 in the front part of the arm 5. In this position, the connector is secured against accidental release. The geometry of the ramp 4 and arm 5 is such that, if the plugging-in operation is not completed, the plug-in connection releases automatically, alia because the end-face part of the arm 5 slides back down the ramp of the projection 4. No electrical connection exists between the contact pairs in the released position. A short circuit bridge 15 is installed in part 1 and consists of two metal tongues which are interconnected by a web and which are pressed resiliently against the contact pins, the tongues being released by the entry of the second plug part from the contact pins of the first plug part. The tongues extend inclinedly rearwards from an inner wall of the collar 3 into the plug interior towards the pins. A resilient ramp is thus formed which, in the event that plugging-in is incomplete, also resiliently pushes back, and therefore separates, the second plug part from the first plug part. The locking arm 5 has on its top a locking arm receiving means, in the form of a slide 7, which is slidable in the plugging direction. As can be seen from FIG. 2, the slide 7 is formed on its longitudinal edges with grooves 8 open towards the interior and engageable by projections 16 on the arm 5, so that the slide 7 is guided in its longitudinal movement. When in the front end position, the front end 12 of the slide 7 engages below the stirrup 6 and projects therefrom at its other end, as will be clearly apparent from FIG. 3, so that the secured position of the connection is readily perceptible visually. In the release movement of the slide from the stirrup, the slide is held captive by a catch projection 9 on the arm and on the inside of the slide 7 by a corresponding abutment projection 10. The slide 7 and the stirrup 6 are so constructed that, if the slide 7 is already in its end position before the plugging operation, the slide is blocked during the closing of casing members 1 and 2 by the stirrup 6 on the plug part 1, and closure is prevented. If the plugging operation continues, the blocked slide 7 returns to its initial position in the opposite direction and the connection is closed by the dynamic movement of the plugging operation.

A grip is disposed on the plug part 2 simplifies manipulation during the opening and closing of the connection. In the withdrawn position, the slide 7 projects to the rear beyond the foot of the arm 5, so that vertical downward pressure applied to the slide end 11 raises the slide front end 12 together with the locking arm 5 secured thereon. This causes locking arm 5 to disengage from the projection 4 so that the connection between the two connector parts can be released. Consequently, the connector according to the invention can be released as required just as readily as the prior art connectors, but without the risk of the additional locking opening accidentally. The additional security is achieved by simple means which are simple to devise and which do not greatly increase the cost of production.

What is claimed is:

1. A connector having a two part casing comprising first and second casing parts adapted to be plugged together, the first casing part engaging at least to some extent by way of a collar around the second casing part in a plugged-together position, and an additional latchable locking means disposed on the two casing parts, wherein the additional locking means comprises:

(a) a first catch projection disposed on a surface of said collar;

(b) a locking arm secured to the second casing part and cooperating with said first catch projection; and (c) a slide having a shroud for substantially entirely covering said locking arm as a means for securing the locking arm, the slide being mounted on the locking arm and being movable on the locking arm longitudinally thereof and extending the locking arm into an advanced position until the slide engages a stirrup located on the second casing part downstream of the first catch projection, whereby the slide abuts under the stirrup so as to retain the locking arm on the fist catch projection;

(d) said slide and said locking arm being interconnected by way of grooves in said shroud.

2. A connector according to claim 1, wherein, in a withdrawn position of the slide, a rear end projects so far beyond a rear end of the locking arm that depressing said rear slide end causes the locking arm to release from the catch projection on the surface of said collar.

3. A connector according to claim 2, wherein a rear portion of the locking arm comprises a blocking element positioned on the second casing part below the rear end of the slide, and prevents the locking arm from releasing from the catch projection.

4. A connector according to claim 1, wherein the slide (7) has a tip and is of a length such that in its forward position, said tip projects beyond the stirrup (6) so that said tip (12) is visible.

5. A connector according to claim 1, wherein in the event of incomplete latching, the catch projection (4) and the locking arm (5) slide off one another and release the plug connection.

6. A connector according to claim 1, including a short-circuit bridge (15) having resilient tongues which extend inclinedly and in a ramp-like manner from the front of the first casing part (1) towards plug pins and which short-circuits the same in the event of incomplete latching of the additional locking means.

7. A connector according to claim 1, including a second catch projection disposed on the locking arm and an abutment projection disposed on an inside of the slide, wherein movement of said second catch projection and said abutment projection into abutment with one another delimits a rear position of said slide.

* * * * *